United States Patent [19]

Saunders

[11] 4,124,984

[45] Nov. 14, 1978

[54] MINE ROOF SUPPORTS

[75] Inventor: Graham J. Saunders, Newcastle upon Tyne, England

[73] Assignee: Huwood Limited, Durham, England

[21] Appl. No.: 835,889

[22] Filed: Sep. 23, 1977

[30] Foreign Application Priority Data

Sep. 24, 1976 [GB] United Kingdom ..... 39650/76

[51] Int. Cl.[2] ..... E21D 17/02

[52] U.S. Cl. ..... 405/293

[58] Field of Search ..... 61/45 D; 248/354 H, 248/357; 299/31, 33

[56] References Cited

U.S. PATENT DOCUMENTS 3,240,021 3/1966 Meriaux et al. ..... 61/45 D 3,732,699 5/1973 Stevenson ..... 61/45 D

FOREIGN PATENT DOCUMENTS 1,243,612 7/1967 Fed. Rep. of Germany ..... 61/45 D

*Primary Examiner*—Mervin Stein
*Assistant Examiner*—David H. Corbin
*Attorney, Agent, or Firm*—Kemon & Estabrook

[57] ABSTRACT

A mine roof support embodying a roof engaging cover and a forepole. The cover is composed of a leading part and a trailing part relatively adjustable with respect to one another. A base member is provided with a plurality of hydraulic rams engagable with said cover for raising and lowering same. The forepole is capable of being extended and retracted with respect to the leading part of the cover.

6 Claims, 7 Drawing Figures

11
12
25a
20
16
14
40
41a
42
41
21
43
44

MINE ROOF SUPPORTS

This invention relates to mine roof supports. Supports are known in which means is provided for holding a cover, or canopy, in contact with the roof of a mine to hold up the roof. Such supports have also been provided with a forepole; as material in front of the support is removed, the forepole can be extended to support the extension of the roof that is created by this removal. The present invention provides a development of those known roof supports.

According to the present invention, there is provided a mine roof support having a roof-engaging cover and a forepole, in which the cover is formed by a leading and a trailing part with the former reciprocable within a range of movement relatively to the latter so that the overall length of the cover may be varied, the forepole is associated with the leading part, means is provided whereby the forepole may be reciprocated in the fore-and-aft direction relatively to the trailing part through a range that projects forwardly of the range of movement of the leading part relatively to the trailing part, and means whereby movement in each direction of the forepole through a section of its range of movement effects corresponding movement of the leading part relatively to the trailing part.

By way of example an embodiment of the invention will now be described with reference to the accompanying drawings in which.

Figure 1:
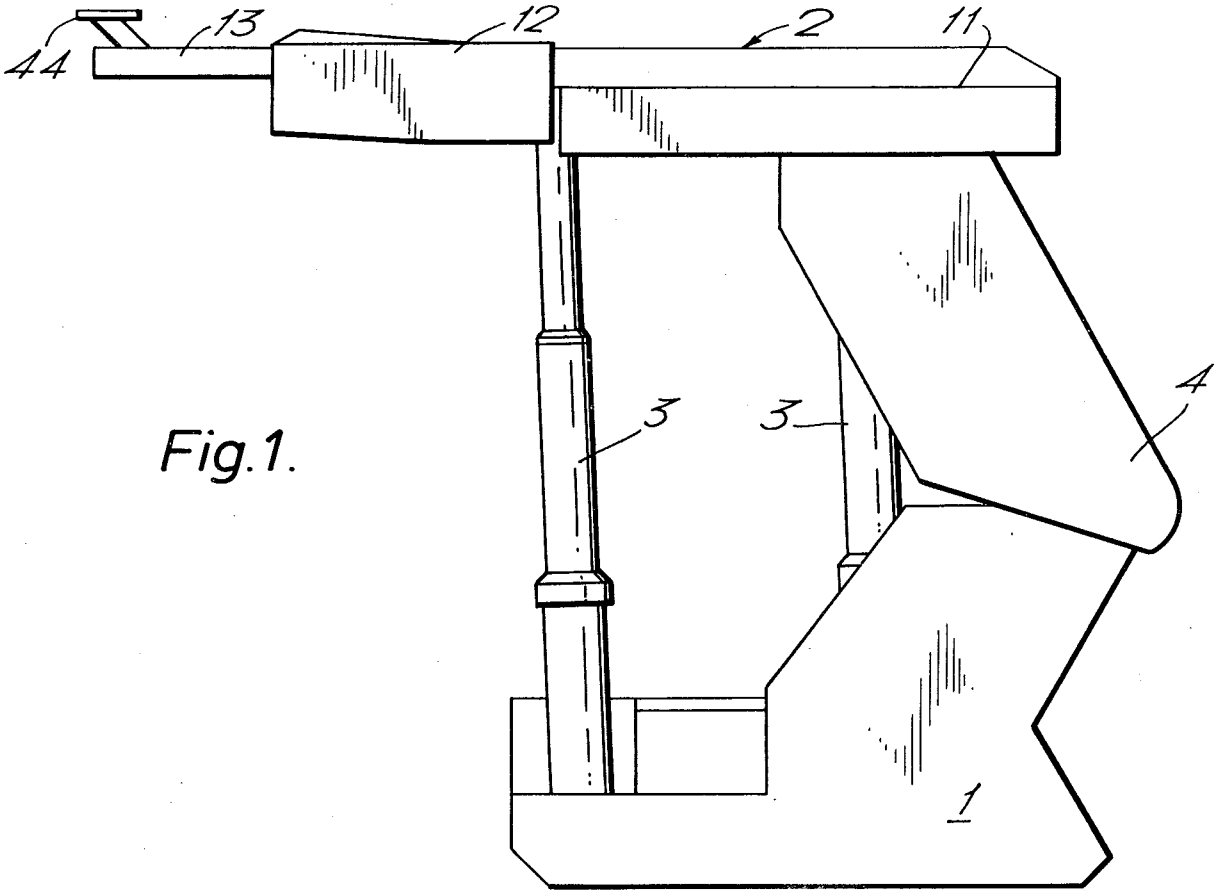
FIG. 1 shows in side view a mobile mine roof support having an extensible cover or canopy and a forepole, with the cover fully extended and the forepole fully projected

The mine roof support illustrated in the drawings (see especially FIG. 1) includes a base 1 and a cover, or canopy, indicated generally at 2, carried from the base 1 by four hydraulic rams 3. By operation of the rams 3, the separation between the base 1 and the cover 2 can be varied; with the cover 2 lowered, the support can move along the mine and by expanding the rams 3, the cover 2 can be forced into supporting engagement with the roof of the mine.

The rear end of the cover 2 is connected to the rear end of the base 1 by a framework 4 incorporating a "lemniscate" linkage of which the knuckle extends more to the rear of the base 1 as the cover 2 is lowered towards it. The effect of the "lemniscate" linkage is to ensure that as the cover 2 rises and falls relatively to the base 1, the connection between the cover 2 and the framework 4 moves in a direction that is generally parallel to the rams 3 so as to minimize any tendency of that cover to move parallel to itself and so apply distorting forces to the rams 3. The connection between the cover 2 and the framework 4 is such as to permit the cover to tilt to some extent in all directions relatively to the framework 4, and such a connection is described in our co-pending application No. 36517/76.

The canopy 2 that is illustrated in the accompanying drawings includes a trailing part 11 and a leading part 12, each having a flange extending downwardly from its sides, and a forepole 13. It is the trailing part 11 that is connected to the framework 4. The leading part 12 is reciprocable along the trailing part 11, within a range of relative movement, and means is provided for locking the two parts together in any of four relative positions. The means consist of four circular openings 14 in each of the flanges of the trailing part 11, a circular opening 15 in each of the flanges of the leading part 12, and pins 16 that fit closely in the openings. In each of the four relative positions in which the leading part 12 can be locked to the trailing part 11, the opening 15, on each side of the leading part 12, coincides with an opening 14, and to lock the parts together, a pin 16 lies in the two co-incident holes.

The forepole 13 is carried by, and beneath, the leading part 12. The forepole 13 includes two capsules 20 each mounted in a slide 21 included in the leading part 12 of the cover. When the cover 2 is fully retracted the slides 21 lie forwardly of the trailing part 11.

The capsules 20 lie symmetrically one on each side of the centre line of the leading part 12 and the top plate 25*a* of each capsule 20 is part of a yoke 25 that connects them rigidly together to form a carrier for a roof supporting beam 44. An abutment 26 extends downwardly from the leading edge of the yoke 25 and a hydraulic ram 28 is anchored at its rear end to the trailing part 11 of the cover and at its forward end to the abutment 26. The connections at the ends of the ram 28 permit it to swivel relatively to the members to which it is connected.

At the trailing end of each capsule 20, a stop 30 projects outwardly. Fixed to the leading part 12 adjacent the rear end of the slide 21, is a buffer 32 such as, by contact with the stop 30, to limit the forward movement of the forepole 13 relatively to the leading part 12.

Figures 5, 6, 7:
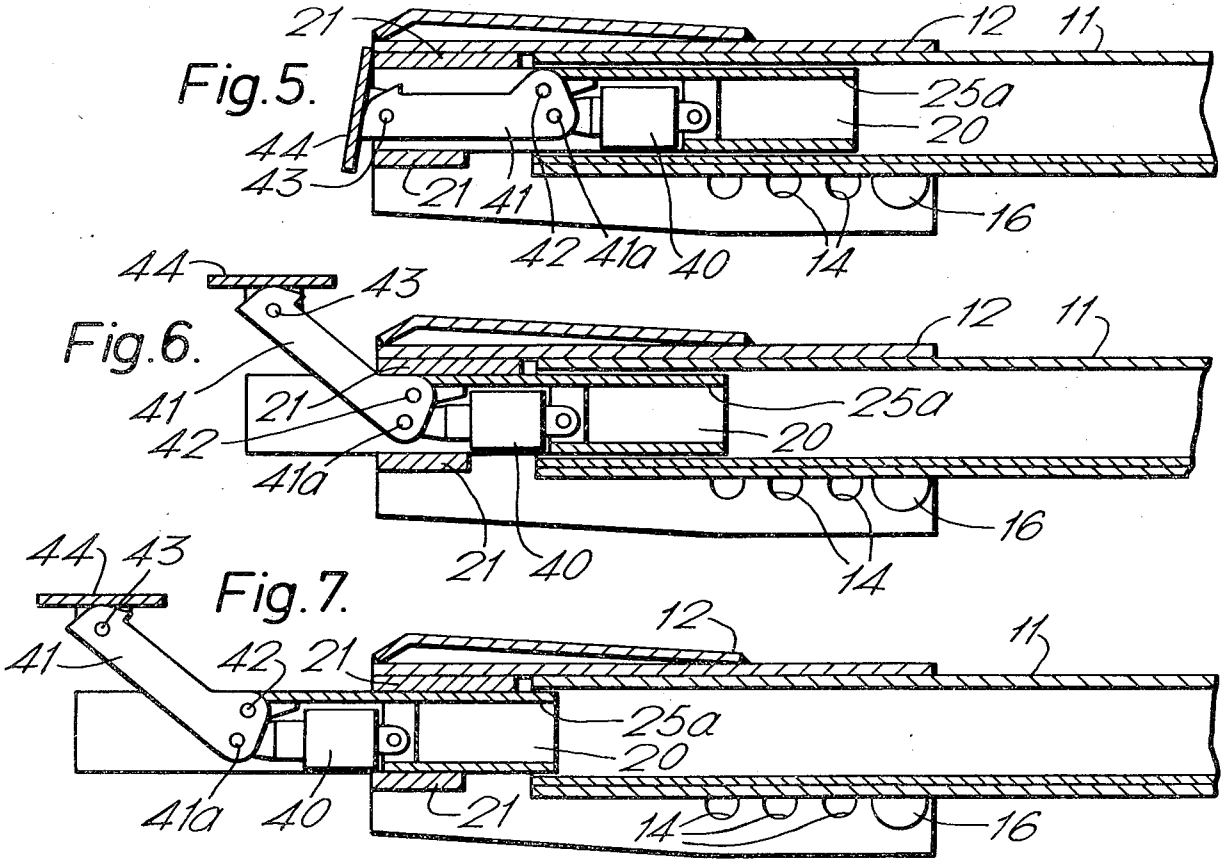
FIG. 5 is section section through FIG. 4 on the line V—V.
FIG. 6 is a section, similar to that of FIG. 5, but showing the forepole in one operative condition.
FIG. 7 is a section, similar to that of FIG. 5, but showing the forepole in another operative condition.

Housed within each capsule 20 is an actuator 40, in the form of a piston-and-cylinder, of which the rear end of the cylinder is fixed to the capsule 20 and the front end of the piston is pivotally connected to the elbow 419 of an L-shaped arm 41. There is a fixed pivotal connection 42 between the other end of the shorter branch of the arm 41 and the capsule 20. The other end of the longer branch of the arm 41 is pivotally connected at 43 to the flat roof supporting beam 44 extending across the width of the cover. By operation of the actuators 40, the arms 41 can be swung from the positions in which they are shown in FIG. 5 to the positions in which they are shown in FIGS. 6 and 7. The pivotal connections between the arms 41 and the beam 44 are such that by swinging the arms, the beam moves from the nearly vertical orientation in which it is shown in FIG. 5 to the horizontal orientation in which it is shown in FIGS. 6 and 7. By full operation of the actuators 40, the beam 44 could be moved to a position just above the canopy provided that the mine roof does not prevent movement to this full extent.

Figure 3:
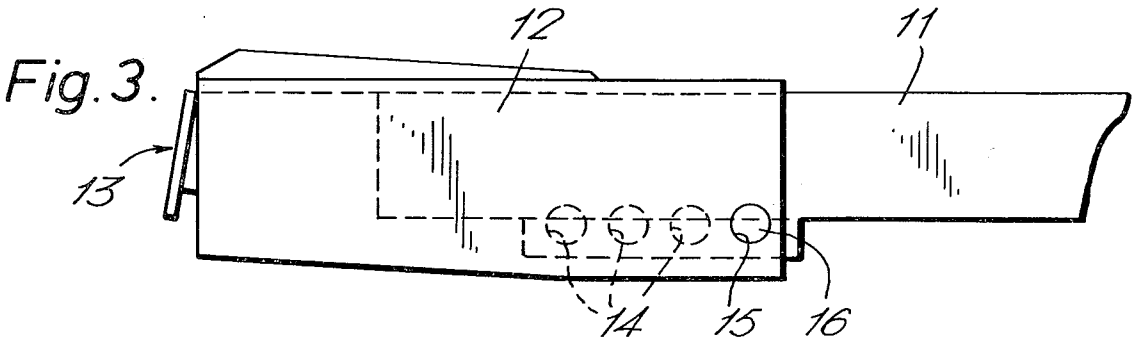
FIG. 3 is a somewhat diagrammatic representation of the same detail of FIG. 1 with the cover fully contracted and the forepole fully retracted.
Figure 4:
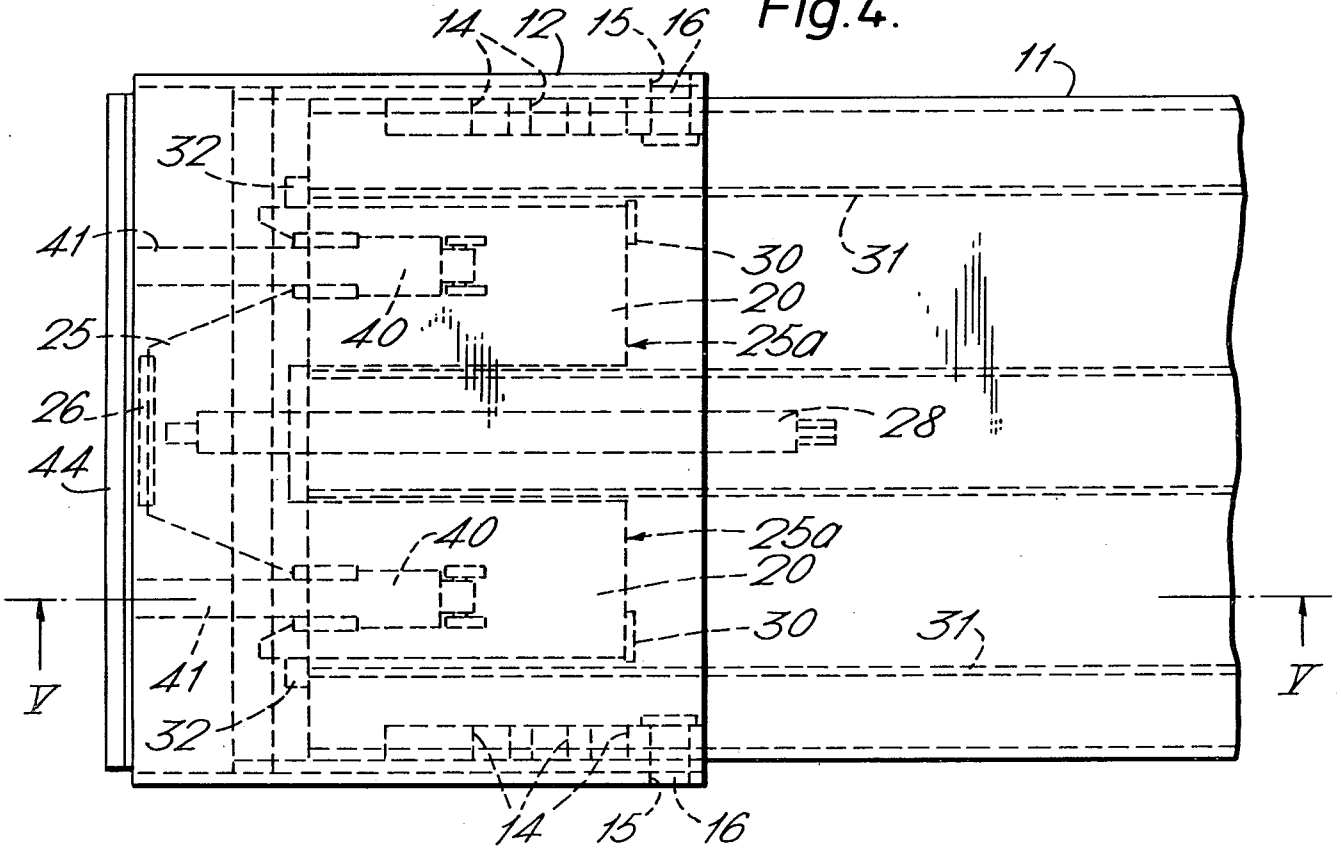
FIG. 4 is a plane view corresponding to FIG. 3 with details that lie beneath the cover shown in broken lines.

To use the support that has been described, the rams 3 are operated to lower the cover 2 so that the support can be brought into position at a coal face in a mine. The cover 2 is fully contracted so that the trailing part 11 and the leading part 12 are connected together with the pins 16 in the positions shown in FIG. 3 and the forepole 13 fully withdrawn. When the support is in position, the rams 3 are extended to bring the cover 2 into supporting contact with the mine roof, the connection between the cover 2 and the framework 4 allowing the cover to tilt to take account of irregularities in the roof.

After coal in front of the support has been cut away, to extend the roof forwardly of the support, the ram 28 is operated to push the forepole 13 forwardly to the desired new position. The actuators 40 are then operated to raise the arms 41 and bring the beam 44 into its horizontal roof engaging position. Further forward projection of forepole 13 is subsequently possible by operation of the ram 28 until the stops 30 abut the buffers 32. To extend the effective length of the cover beyond this, the pins 16 are removed when further operation of the ram 28, through the co-operation of the stops 30 with the buffers 32 will push the leading part 12 forward relatively to the trailing part 11. When the openings 15 coincide with the appropriate ones of the other openings 14, the pins 16 are restored to the coincident holes.

Figure 2:
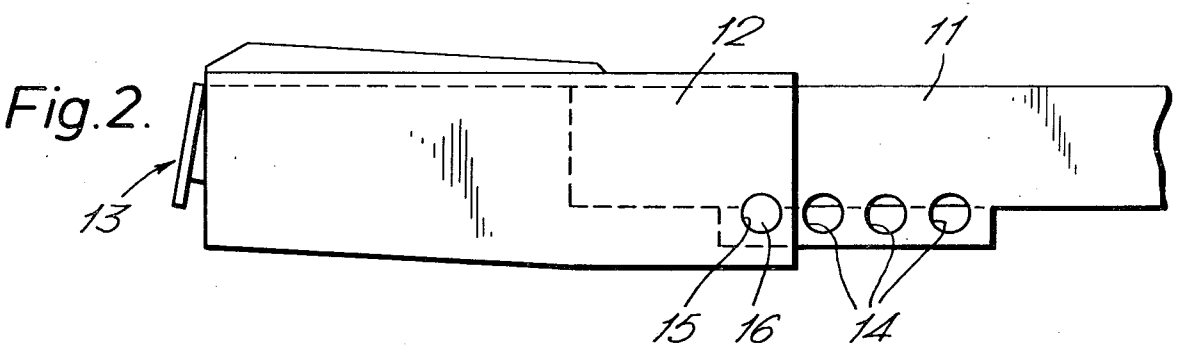
FIG. 2 is somewhat diagrammatic representation of a detail of FIG. 1, with the cover fully extended and the forepole retracted relatively to the extended cover.

When the cover has been fully extended with the parts 11 and 12 in the position shown in FIG. 2 and the forepole in the position shown in FIG. 7, further extension of the roof will require that the support be moved forward. The cover 2 is therefore lowered relatively to the base 1. The pins 16 are then removed and the ram 28 is operated to withdraw the forepole 15. When the forepole 15 is in its most withdrawn position, contact between it and the leading part 12 will be such that continued operation of the ram 28 will cause the leading part 12 to slide back along the trailing part 11 until the original relative positions are achieved. The support can then be moved forward bodily, and the sequence repeated.

I claim:

1. A mine roof support having a roof engaging cover and a forepole, in which the cover is formed by a leading and trailing part with the former recipropable within a continuous range of movement relatively to the latter so that the overall length of the cover may be varied, the forepole is associated with the leading part, fluid operated piston means are connected between the forepole and the trailing part and the stroke of the piston means is such that the forepole may be reciprocated in the fore-and-aft direction relatively to the trailing part through a continuous range of which a section lies forwardly of the range of movement of the leading part relatively to the trailing part, abutment surfaces provided by the leading part and the forepole co-operate when the leading part is retracted and the forepole reaches the forward end at the forwardly lying section so that further forward movement of the forepole results in corresponding forward movement of the leading part, and further abutment surfaces provided by the leading part and the forepole co-operate when the leading part is extended relatively to the trailing part and the forepole reaches the rearward end of the forwardly lying section so that further rearward movement of the forepole results in corresponding rearward movement of the leading part.

2. A mine roof supports as claimed in claim 1 in which means is provided by which the leading part can be releasably anchored to the trailing part at a location within its range of movement.

3. A mine roof support as claimed in claim 1 in which the forepole includes a roof beam and carrier means on which the roof beam is pivotally mounted, the carrier means also incorporating actuators by which the beam can be swung between a location level with, or above, the cover and a level below the cover.

4. A mine roof support as claimed in claim 3 and being such that the forepole can be adjusted to a position relatively to the leading part in which the roof beam acts as a flange extending downwardly from the leading edge of the leading part.

5. A mine roof support as claimed in claim 3 in which the carrier means includes two similar units disposed symmetrically across the width of the cover, and the means whereby the forepole may be reciprocated acts on the carrier means midway between the units.

6. A mine roof supports as claimed in claim 5 in which the means whereby the forepole may be reciprocated is hydraulic ram of which one end is fixed relatively to the carrier means and the other end is fixed relatively to the trailing part of the cover.

* * * * *